United States Patent [19]

Strok

[11] 4,052,636

[45] Oct. 4, 1977

[54] HIGH PRESSURE SODIUM VAPOR LAMP STABILIZED FOR PULSE OPERATION

[75] Inventor: Jack M. Strok, Northfield, Ohio

[73] Assignee: General Electric Company, Schenectady, N.Y.

[21] Appl. No.: 710,487

[22] Filed: Aug. 2, 1976

[51] Int. Cl.[2] ..... H01J 61/06

[52] U.S. Cl. ..... 313/217; 313/229; 313/219; 313/213

[58] Field of Search ..... 313/217

[56] References Cited

U.S. PATENT DOCUMENTS

| | | | |
|---|---|---|---|
| 3,473,071 | 10/1969 | Rigden et al. | 313/220 |
| 3,708,710 | 1/1973 | Smyser et al. | 313/213 |

FOREIGN PATENT DOCUMENTS

| | | |
|---|---|---|
| 2,267,635 | 7/1975 | France |

*Primary Examiner*—Rudolph V. Rolinec
*Assistant Examiner*—Darwin R. Hostetter
*Attorney, Agent, or Firm*—Ernest W. Legree; Lawrence R. Kempton; Frank L. Neuhauser

[57] ABSTRACT

High pressure sodium vapor lamps operated on sonic frequency pulses with short duty cycle in order to raise the color temperature are subject to arc instability near the electrodes and to overheating of the end closures, particularly that at the anode end when unidirectional pulsing is used. Stability and long life is achieved and overheating is prevented by using electrodes of cross-sectional area from 0.3 to 0.4 times the envelope cross section and lengthening the distance from closure to electrode tip so that the arc gap is less than 80% of the gas column length.

11 Claims, 3 Drawing Figures

HIGH PRESSURE SODIUM VAPOR LAMP STABILIZED FOR PULSE OPERATION

The invention relates to high pressure sodium vapor lamps specially designed for operation on sonic frequency pulses with short duty cycles in order to raise the color temperature and improve the color rendition, and is concerned with achieving arc stability and long life.

BACKGROUND OF THE INVENTION

High pressure sodium vapor lamps are now well-known and widely used for street, roadway and area lighting applications. The basic lamp type is described in U.S. Pat. No. 3,248,590 — Schmidt, 1966, "High Pressure Sodium Vapor Lamp", and generally comprises an outer vitreous envelope or jacket of glass within which is mounted a slender tubular ceramic arc tube. The ceramic envelope is made of a light-transmissive refractory oxide material resistant to sodium at high temperatures, suitably high density polycrystalline alumina or synthetic sapphire. The filling comprises sodium along with a rare gas to facilitate starting, and mercury for improved efficiency. The ends of the alumina tube are sealed by suitable closure members affording connection to the electrodes. The outer envelope is generally provided at one end with a screw base having shell and eyelet terminals to which the electrodes of the arc tube are connected.

Up to the present time high pressure sodium vapor lamps have been conventionally operated on 60 cycle alternating current by means of ballasts which limit the current to the lamp rating. In such operation, the light generated by the discharge is due almost exclusively to the excitation of the sodium atom through the self-reversal and broadening of the sodium D-line at 589 nanometers. The lamp efficacy is high, up to 130 lumens per watt depending upon lamp size, but the color temperature is low, from 2000° to 2100° Kelvin. While object colors in all portions of the spectrum are recognizable, those at the "cool" end such as violets, blues and to some extent greens are muted or grayed down. As a result, the lamp has not been generally acceptable for indoor applications, particularly where critical color discrimination is required.

More recently, the color temperature of high pressure sodium vapor lamps has been raised and their color rendition has been improved by going to pulse operation. The method is described and claimed in copending application Ser. No. 649,900 of Mitchell M. Osteen, filed Jan. 16, 1976, titled "Color Improvement of High Pressure Sodium Vapor Lamps by Pulsed Operation," and assigned like this application. By utilizing pulse repetition rates in the sonic range from 500 to 2000 hertz and short duty cycles from 10 to 30%, the color temperature has been increased from the common value of 2050° K to as high as 2700° K.

SUMMARY OF THE INVENTION

Problems encountered in pulse operation of high pressure sodium vapor lamps are arc instability near the electrodes and at the center of the discharge, overheating of the end closures, particularly that at the anode end when unidirectional pulsing is used, and reduced life over 60 hz a.c. operation. Observation of discharges 4 cm or shorter in length shows the greater part of the arc to be stable, but near the electrodes there is motion.

The arc excursions may produce considerable flicker. Also the undesirable arc wavering can cause oscillation of the lamp electrical impedance and local thermal stress in the alumina arc tube which can lead to arc tube cracking. Pulsed discharges longer than 4 cm in arc length not only suffer from instability near the electrodes, but also from instability in the mid portion of the arc. Overheating of the end closures is due to greater electrode power dissipation and can cause lamp failure by cracking the glass seal between the alumina arc tube and the end closures. Reduced life is also the result of arc tube blackening at both ends which occurs with conventional electrode geometry. The object of the invention is to provide a lamp design suitable for pulse operation and overcoming these problems.

My studies indicate that instability near the electrodes is due to excitation of the lowest order longitudinal acoustic resonance by resonant frequency components in the lamp pulse waveform, and that electrode geometry has a considerable effect upon the ease of excitation of such resonances. I have found that in lamps where the insertion depth of the electrodes into the arc tube is appreciable, arc instability can be reduced and lumen maintenance can be increased by making the cross-sectional area of the electrodes from 30% to 40% that of the arc tube. Also heating of the end closures can be reduced by increasing the insertion depth of the electrodes into the arc tube.

In lamp designs embodying the invention, arc stability and long life are achieved and end closure overheating is prevented by using electrodes of cross-sectional area from 0.3 to 0.4 times the envelope cross section, and by lengthening the closure to electrode tip distance so that the ratio of arc gap to gas column length is less than 0.80. The arc gap is the distance between the tips of the electrodes, and the gas column length is the distance from end wall to end wall or to anti back-arcing shield when such is used within the arc tube. In a preferred design for unidirectional sonic pulse operation, the anode is of tungsten but does not include emission material; the insertion depth of the anode into the arc tube is greater than that of the cathode and only the cathode has an anti back-arcing shield behind it.

DETAILED DESCRIPTION

Figure 1:
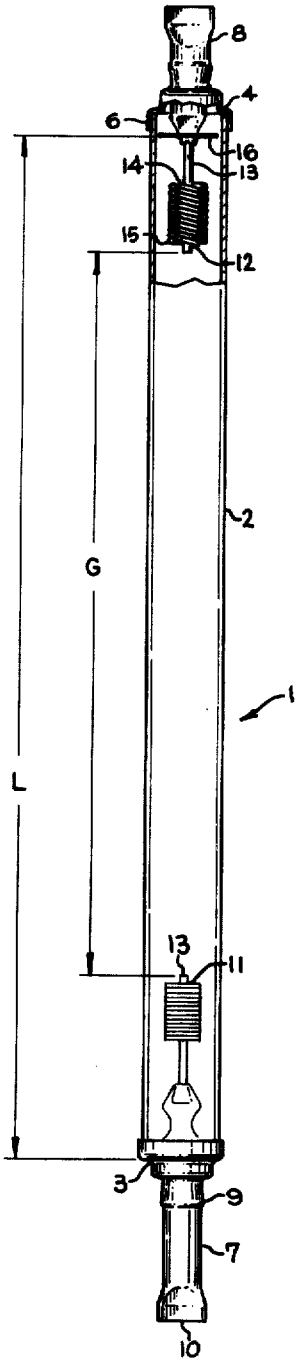
FIG. 1 shows the arc tube of a high pressure sodium vapor lamp embodying the invention.

The invention may be embodied in the arc tube of a high intensity sodium vapor discharge lamp comprising a vitreous outer jacket provided with a base at one end such as shown in the previously mentioned Osteen application. Only the inner discharge envelope or arc tube 1 is illustrated in FIG. 1 herein. It comprises an envelope 2 of ceramic tubing, consisting of sintered high density polycrystalline alumina which is translucent, or alternatively of single crystal alumina which is clear and transparent. The ends of the ceramic tube are closed by thimble-like niobium closures or end caps 3, 4 hermetically sealed to the ceramic by means of a sealing composition comprising primarily alumina and calcia. One suitable sealing composition is described and claimed in U.S. Pat. No. 3,588,577 — McVey et al., 1971, "Calcia-Alumina-Magnesia-Baria Seal Composition". The sealing composition is located between the expanded shoulder portion 6 of the end cap and the side and end of the ceramic tube.

Niobium tubes 7, 8 penetrate into the thimbles 3, 4 and are hermetically welded to the thimble necks 9. The lower tube 7 is an exhaust tube and has an aperture communicating with the interior of the envelope. After the filling comprising the sodium-mercury amalgam and the inert starting gas such as xenon is introduced into the envelope, the exhaust tube is hermetically pinched shut at 10 and serves as a reservoir in which excess sodium mercury amalgam condenses during operation. Tube 8 at the upper end is similar but has no opening into the interior of the envelope and is commonly referred to as the dummy exhaust tube. The electrodes 11, 12 comprise a body portion formed of tungsten sire helically coiled on a tungsten shank 13 in two superposed layers 14, 15. The turns of the inner layer 14 may be open-wound and the interstices between turns filled with emission material. The electrode shanks are welded in the crimped ends of niobium tubes 7, 8 which serve as supports and inleads. By way of example, the arc tube contains a filling of zenon at a pressure of about 20 torr serving as a starting gas and a charge of 25 milligrams of amalgam of 25 weight percent sodium and 75 weight percent mercury.

A lamp intended for pulse operation embodying the invention differs from a conventional lamp intended for 60 cycle operation by reason of the electrode activation and anti back-arcing shield location if the pulsing is to be unidirectional, by reason of the insertion dept of the electrodes into the ends of the arc tube, and by reason of the electrode size or cross section.

ELECTRODE ACTIVATION

In lamps intended for a.c. operation, both electrodes have the interstices between turns of the tungsten wire coil filled with emission material, suitably dibarium calcium tungstate $Ba_2CaWO_6$. However on direct current or on unidirectional pulsing, the anode runs hotter than the cathode. Emission material at the anode performs no useful function because electron emission is not required from it; it may be detrimental to lamp maintenance because higher temperatures at the anode cause it to vaporize and discolor or darken the envelope wall. Accordingly in a lamp intended for unidirectional pulse operation, emission material is provided in the cathode only; the anode construction may be similar to the cathode but without emission material. An anti back-arcing shield consisting of a niobium disc 16 is mounted on tungsten shank 13 behind cathode 11; no shield is needed behind anode 11.

INSERTION DEPTH OF ELECTRODES

Figure 2:
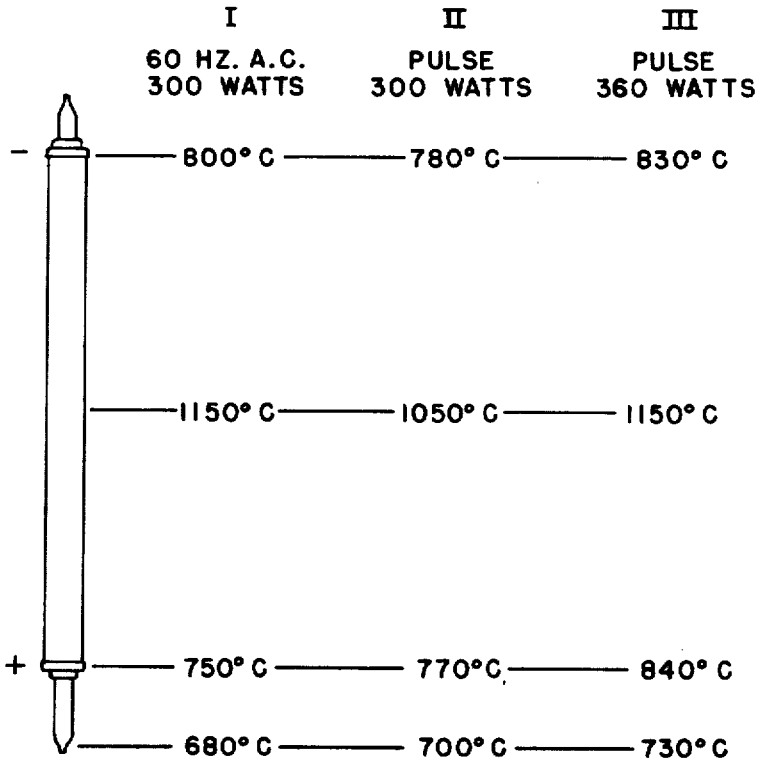
FIG. 2 combines an outline of an arc tube and a correlated chart of its temperature at critical points under several modes of operation.

A greater electrode insertion depth is required at both ends of a pulsed arc tube optimized for lumen output than at the ends of a 60 hz a.c. arc tube similarly optimized and having the same external temperature profile. The reason therefor may be understood by referring to FIG. 2 wherein the arc tube temperature profile of the outlined prior art lamp under conventional 60 hz alternating current operation is given in column I; that of the same lamp under sonic short duty-cycle pulse operation is given in column II. The power input to the lamp was the same in both cases; in the pulsed lamp the pulse repetition rate was 1200 hz, with 22% duty cycle. The anode (reservoir) electrode becomes relatively hotter and the cathode becomes relatively cooler in the pulsed lamp. Ordinarily this would require as corrective measures greater insertion of the anode electrode and less insertion of the cathode. However, the maximum arc tube wall temperature is typically 100° C lower during pulsing, dropping from 1150° C to 1050° C as indicated. Experience shows that lamp efficacy and color temperature are best under the highest average power input consistent with acceptable wall loading. Therefore, to raise the wall temperature back to the 1150° C temperature which prevailed under 60 hz a.c. excitation, about 20% more power must be supplied under sonic pulse excitation. When this is done, the temperature profile given by column III results in which the end seal temperatures, 830° C at the anode and 840° C at the cathode end, are excessive. In order to take care of the greater electrode dissipation at both ends under these conditions, I increase the electrode insertion depth. I make the anode insertion depth greater than at least twice the arc tube bore, and also greater than the cathode insertion depth.

By way of example, the lamp illustrated in FIG. 1 which is intended for sonic short duty-cycle pulse operation at 300 watts input has a bore (I.D.) of 5.5 millimeter and length of 90 mm. It uses a cathode activated with $Ba_2CaWO_6$ and an anode of bare tungsten wire not containing any activation material. The electrode insertion depth, that is the distance measured from the tip of the shank 13 to the inside transverse surface of the end cap 3 or 4 which is contacted by the alumina tube is 15.9 millimeters for the anode at the exhaust end, and 12.0 millimeters for the cathode at the dummy end of the lamp. This compares with 9.6 millimeters and 8.3 millimeters for the electrodes at the exhaust and dummy respectively of a prior art lamp of similar dimensions intended for 60 hertz a.c. conventional operation.

ARC STABILITY

The arc instability near the electrode appears to be due to excitation of the lowest order longitudinal acoustic resonance within the vapor filling of the lamp by resonant frequency components in the pulse power waveform. I have found that electrode geometry has a strong effect upon the ease of excitation of acoustical resonance and upon the amplitude of the undesirable instability. In longitudinal resonance in the basic or fundamental mode, the discharge tube has a pressure variation A along its axis expressed by:

$$A = \cos \pi(Z/L)$$

where L = discharge tube length, and Z = distance along discharge path as measured from one end. The center of the tube where Z = L/2 corresponds to a pressure node; maximum variation in pressure occurs at the ends where Z = 0 or L. The pressure variation is in a direction to cause oscillatory longitudinal motion of the enclosed gas column at a frequency $f$ inversely proportional to the length of the column and given by the expression $f = C/2L$ where $c$ = speed of sound in the vapor.

Figure 3:
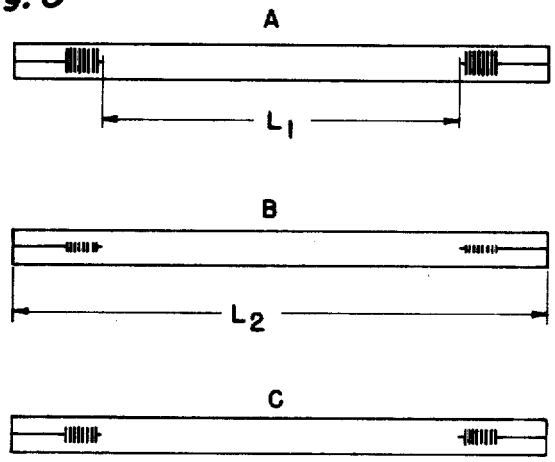
FIG. 3 shows schematically arc tubes with electrodes of large, small and intermediate cross sections respectively.

In comparing oscillations occurring with various electrode geometries, I have found that when the electrode cross section is large relative to the tube cross section, the effective column length is the distance between the front faces of the electrodes; when the cross section is small, the effective length is the distance between the end closures, or between the anti back-arcing shields if used. The foregoing conditions are depicted in FIGS. 3 at A wherein $L_1$ is the column length with large electrodes and at B wherein $L_2$ is the column length with small electrodes. With an electrode of intermediate cross section as illustrated at C, the boundary conditions are such that the pressure oscillations of differing frequency tend to cancel each other out and oscillation is either eliminated or its amplitude is smaller than in either previous case.

Tests of arc stability using various electrode geometries were made in lamps similar to that illustrated in FIG. 1 but utilizing clear monocrystalline alumina arc tubes to facilitate observation of the arc by eye with a dark glass shield. The arc tube internal diameter in these particular lamps was 5.5 millimeters and three sizes of electrode were used whose physical characteristics are summarized in Table I below. The electrode in each case comprises two superposed layers of tungsten wire on a tungsten shank and the overall diameter given in the table is that of the outer layer. The cross-section ratio is the ratio of the electrode cross-section to the cross-sectional area of the tube bore. The anode differed from the cathode only by the absence of $Ba_2CaWO_6$ emission material in the interstices between turns.

TABLE I

| Electrode | Shank Dia. | Wire Dia. | Overall Dia. | Cross-Section Ratio |
|---|---|---|---|---|
| A | 30 mil | 20 mil | 2.8 mm | .26 |
| B | 47 mil | 30 mil | 4.2 mm | .58 |
| C | 47 mil | 20 mil | 3.2 mm | .33 |

The three variations were operated over similar ranges of wall loading and sodium partial pressure with unidirectional pulses at 1 khz, 20% duty cycle and 667 hz 20% duty cycle. The lamps with the large A electrodes were least stable with maximum instability occurring at the 667 hz frequency; in general the arc showed a stationary kink near the cathode and a swirling motion about the anode.

Lamps with the small B electrode showed more stability in that the arc was straight and stationary at the cathode. At the anode however the arc was kinked and displayed considerable motion. With the small electrode stability was about the same at both frequencies.

I have found that lamps using intermediate size electrodes wherein the cross-section ratio is in the range of 0.3 to 0.4 have the greatest stability. With the C size electrodes, the arc was straight at both anode and cathode, and motion at the anode was barely perceptible. Stability was about the same at both frequencies and in addition, in contrast with the behavior observed with the other two electrode sizes, the arc remained stable at increased values of wall loading and sodium pressure.

CORRELATION OF INSERTION DEPTH AND STABILITY REQUIREMENTS

In order to be truly effective, the use of electrodes of intermediate cross section to reduce arc instability on sonic pulse operation requires an appreciable difference between the arc gap length and the gas column length in terms of a wavelength at the fundamental frequency. In practice, this means that the distance between the front face of the electrode and the end closure behind it should be at least 10% of the distance between closures, and preferably closer to 15% or more. This is in contrast to about 7% for comparable lamps of conventional construction, that is, lamps intended for 60 hz a.c. operation. Stated in another way, the ratio of arc gap to gas column length should be less than 80%. In arc tubes of 5 and 5.5 millimeters bore it should preferably be closer to 70%. Thus the requirement of greater electrode insertion depth in order to avoid excessive arc tube end temperature is in the right direction to satisfy the requirement of a lower ratio of arc gap to gas column length which is needed in combination with the feature of electrodes of intermediate size in order to eliminate arc instability and obtain superior lumen maintenance.

By way of illustrative example of the invention, the arc tube in FIG. 1 having a bore of 5.5 mm and length of 90 mm between end caps is intended for unidirectional sonic short-duty cycle pulse operation at 310 watts input. The electrode diameter is 3.2 mm, making the cross-section ratio 0.34. The anode insertion depth is 15.9 mm and the cathode insertion depth 12.0 mm. The anti back-arcing shield 16 behind the cathode is pushed as close to the end wall as possible. The arc gap length G measured between electrode tips is 62.4 mm. The gas column length L measured from the end wall behind the anode to the anti back-arcing shield behind the cathode is 88 mm. The resulting ratio G/L is 0.71.

LUMEN MAINTENANCE

In continuous life testing of lamps with the three electrode sizes, lumen maintenance for the intermediate size electrode was superior to that for either the larger or smaller sizes. At 4000 hours the lamps with electrodes A and B showed appreciable end darkening of the arc tube, while the lamps with size C electrodes were still remarkably clean. Lumen maintenance with the intermediate size electrodes which give maximum arc stability on sonic pulse operation is equal to or exceeds that of conventional lamps on ordinary 60 hz a.c. operation. Also no voltage rise occurred over the 4000 hour interval and no color temperature shift. These serendipitous results indicate the value of a cross-section ratio from 0.3 to 0.4 for the electrodes in combination with the specified insertion depth in a lamp designed for sonic frequency short duty cycle operation.

What I claim as new and desire to secure by Letters Patent of the United States is:

1. A high pressure sodium vapor lamp arc tube for high frequency short duty cycle pulse operation comprising:
   - an elongated light-transmitting ceramic tube having closures sealing its ends and containing a filling of sodium-mercury amalgam;
   - a pair of electrodes supported from said closures at opposite ends of said tube, each comprising a body portion mounted on an axial tungsten shank,
   - the insertion depth of said electrodes into the tube being at least 10% of the gas column length therein,
   - and the ratio of the cross-sectional area of the body portion of said electrodes to the cross-sectional area of the bore of the tube being in the range of 0.3 to 0.4.

2. An arc tube as in claim 1 wherein the body portion of said electrodes comprises tungsten wire coiled around said shank.

3. An arc tube as in claim 1 for unidirectional pulse operation wherein only the cathode electrode contains electron-emissive material within its body portion.

4. An arc tube as in claim 1 for unidirectional pulse operation wherein only the cathode electrode contains electron-emissive material within its body portion and the insertion depth of the anode electrode is greater than that of the cathode electrode.

5. A high pressure sodium vapor lamp arc tube for high frequency short duty cycle pulse operation comprising:

an elongated light-transmitting ceramic tube having closures sealing its ends and containing a filling of starting gas and sodium-mercury amalgam;

a pair of electrodes supported from said closures at opposite ends of the tube, each comprising an axial tungsten shank having tungsten wire coiled around it, the insertion depth of said electrodes into the tube ends determining an arc gap between electrodes less than 80% of the gas column length in said tube, and the ratio of the cross-sectional area of the coiled portion of said electrodes to the cross-sectional area of the bore of the tube being in the range of 0.3 to 0.4.

6. An arc tube as in claim 5 for unidirectional pulse operation wherein only the cathode electrode contains electron-emissive material.

7. An arc tube as in claim 5 for unidirectional pulse operation wherein only the cathode electrode contains electron-emissive material and includes an anti back-arcing shield mounted on said shank behind said cathode, and wherein the insertion depth of the anode is greater than that of the cathode.

8. An arc tube as in claim 7 wherein the arc tube is from approximately 5 to 5.5 millimeters in bore, and wherein the gap between electrodes is close to 70% of the gas column length measured from the end wall behind the anode electrode to said anti back-arcing shield.

9. A high pressure sodium vapor lamp arc tube for high frequency short duty cycle unidirectional pulse operation comprising:

an elongated light-transmitting ceramic tube having closures sealing its ends and containing a filling of sodium-mercury amalgam, a pair of electrodes supported from said closures at opposite ends of the tube, each comprising a body portion mounted on an axial tungsten shank, said body portion in the cathode electrode comprising tungsten wire helically coiled around said shank and including electron-emissive material in the interstices between turns, the insertion depth of said electrodes into the tube ends determining an arc gap between electrodes less than 80% of the gas column length in said tube, and the ratio of the cross-sectional area of the body portion of the electrodes to the cross-sectional area of the bore of the tube being in the range of 0.3 to 0.4.

10. An arc tube as in claim 9 including a disc-like anti back-arcing shield mounted on the shank behind the cathode and wherein the gap between the electrodes is less than 80% of the gas column length measured from the end wall behind the anode electrode to said anti back-arcing shield.

11. An arc tube as in claim 10 wherein the arc tube is from approximately 5 to 55 millimeters in bore, and wherein the gap between the electrodes is close to 70% of the gas column length measured from the end wall behind the anode electrode to said anti back-arcing shield.

* * * * *